US005150913A

United States Patent [19]

Hoelzl

[11] Patent Number: 5,150,913

[45] Date of Patent: Sep. 29, 1992

[54] FINGER OPERATED BUTTON ACTIVATING WIRELESS TRANSMISSION PATH FOR EFFECTING VOLUNTARY RELEASE OF A SKI BINDING

[75] Inventor: Klaus Hoelzl, Vienna, Austria

[73] Assignee: TMC Corporation, Baar, Switzerland

[21] Appl. No.: 798,257

[22] Filed: Nov. 18, 1991

Related U.S. Application Data

[63] Continuation-in-part of Ser. No. 318,457, Mar. 1, 1989, abandoned, which is a continuation of Ser. No. 939,644, Dec. 9, 1986, abandoned.

[30] Foreign Application Priority Data

Dec. 10, 1985 [AT] Austria ..... 3580/85

[51] Int. Cl.[5] ..... A63C 9/088

[52] U.S. Cl. ..... 280/612; 200/43.18; 200/302.2; 200/334; 280/821; 280/824; 280/DIG. 13

[58] Field of Search ..... 280/611, 612, 819, 821, 280/824, DIG. 13; 200/153 T, 330, 334, 340, 302.2, 43.18

[56] References Cited

U.S. PATENT DOCUMENTS

| | | | |
|---|---|---|---|
| 1,907,688 | 5/1933 | von Henke | 200/302.2 |
| 3,614,119 | 10/1971 | Wilkes | 280/DIG. 13 |
| 3,794,339 | 2/1974 | Smolka | 280/612 |
| 4,023,817 | 5/1977 | Lah et al. | 280/821 |
| 4,088,855 | 5/1978 | Emery | 200/302.2 |
| 4,304,973 | 12/1981 | Fenelle et al. | 200/340 |
| 4,545,598 | 10/1985 | Spitaler et al. | 280/612 |

FOREIGN PATENT DOCUMENTS

| | | | |
|---|---|---|---|
| 180027 | 10/1954 | Austria | 280/816 |
| 304329 | 12/1972 | Austria . | |
| 379960 | 3/1984 | Austria . | |
| 1138448 | 10/1962 | Fed. Rep. of Germany | 200/330 |
| 2012872 | 10/1971 | Fed. Rep. of Germany | 280/816 |
| 2200571 | 8/1972 | Fed. Rep. of Germany . | |
| 2219415 | 12/1972 | Fed. Rep. of Germany . | |
| 2402684 | 7/1975 | Fed. Rep. of Germany | 280/612 |
| 467081 | 2/1969 | Switzerland . | |
| 2030773 | 4/1980 | United Kingdom | 200/302.2 |

*Primary Examiner*—Eric D. Culbreth
*Attorney, Agent, or Firm*—Flynn, Thiel, Boutell & Tanis

[57] ABSTRACT

A ski binding comprising a release mechanism controllable voluntarily through a wireless transmission path and releases a lock of a jaw of the binding, which transmission path is controlled by a manually operable switch. To avoid an undesired release of the binding, it is provided that the switch is countersunk into an outwardly opening recess in the handle on a skipole, so that the manually operable part of a button on the switch can be manually engaged only by purposefully inserting a finger of a user's hand into the recess.

6 Claims, 5 Drawing Sheets

21'
2
36
18'
35
34

FINGER OPERATED BUTTON ACTIVATING WIRELESS TRANSMISSION PATH FOR EFFECTING VOLUNTARY RELEASE OF A SKI BINDING

This application is a continuation-in-part of U.S. Ser. No. 07/318 457, filed Mar. 1, 1989, now abandoned, which was a continuation of U.S. Ser. No. 06/939 644, filed Dec. 9, 1986, now abandoned.

FIELD OF THE INVENTION

The invention relates to a ski binding comprising a release mechanism, which can be controlled voluntarily through a wireless transmission path and which releases a lock of a jaw on the binding. The transmission path is controlled by a finger operated switch on a skipole.

BACKGROUND OF THE INVENTION

Such a binding has been known already for a long time through Austrian Patent No. 304 329. However, this known solution provides a cable connection between a switch arranged on the handle of the skipole and a release mechanism, which is constructed as an electromagnet. This solution has the disadvantage that the switch is arranged on the free front face of the skipole handle and projects significantly from the face. This results often in an unintended release of the binding leading to avoidable falls.

Furthermore, Swiss Patent No. 467 081 discloses a binding having a wireless control for a release mechanism, in which the binding can be released in case of danger by an impulse transmission to the release mechanism, whereby the transmitter needed for this is secured on the body of the skier or on a skipole. Since according to this suggestion, the release is supposed to occur in case of danger, the switch must be easily accessible. Therefore, this solution also has the same disadvantages which were mentioned in connection with the solution according to the abovementioned Austrian patent.

SUMMARY OF THE INVENTION

The goal of the invention is to provide a binding of the abovementioned type, which permits a comfortable stepping out of the binding, in particular a stepping out without bending down. The safety function of the binding, which as a rule is assured by the construction of the jaw of the binding, is supposed to be met alone through the binding, whereas a voluntary release is supposed to be initiated through the abovementioned wireless transmission path.

The invention therefore provides that the switch, protected against an unintended operation, is secured on the equipment, preferably on a skipole.

This measure practically assures that only conscious releases of the binding are initiated through the transmission path; namely, that a release of the binding through the wireless transmission path occurs only intentionally and during standstill and not automatically, for example as a result of fear reactions during downhill skiing, which often results for the skier in surprising and therefore dangerous falls. It is advantageous to arrange the switch on the ski pole, however, it is also possible to deviate from this concept by securing the switch on a different part of the equipment, for example on a back pocket or another part of the clothing. The switch can thereby be housed in a suitably solid housing. In the case of housing the switch, for example, in a back pocket or at any other part of the clothing, a complete protection against an automatic operation also exists. Thus, an undesired release of the binding during downhill skiing cannot occur caused by a reaction due to fear.

According to a further characteristic of the invention, the switch can be mounted to the free top face of the handle of the skipole and can be countersunk therein. This results in a very simple construction and yet an automatic operation is practically completely impossible. Thus, the handle of the skipole, as a rule, is not held at its free top face, but same projects between the index finger and thumb of the hand gripping around the handle. Furthermore, the switch cannot be operated due to its countersunk arrangement and finite size, not even if, for example, the thumb is placed onto the front face of the handle, but can be switched only with the end of a finger, which must practically occur in axial direction. This, however, is only consciously possible.

A further possibility to prevent an unintended or automatic operation of the switch consists in the switch being arranged in the handle of a skipole and being operable by rotating the handle relative to the skipole or a part of the handle. This embodiment practically demands, for a voluntary release of the binding, one to grip the skipole provided with the switch with the one hand and to turn the handle or the rotatable part of the handle with the other hand. However, an unintended operation of the switch is absolutely impossible with this construction.

The switch may in this connection be provided in a stationary part of the skipole handle, at the underside of which a ring is rotatably housed. The ring has a raised area cooperating with an operating element of the switch and is initially pretensioned preferably by a spring against a rest position not operating the switch. This results in a very simple construction. Arranging the ring operating the switch on the underside of the skipole handle substantially avoids unintended operations, whereby in addition it must be considered that skipole handles as a rule have in their lower part, that is, their area closer to the skipole tip, a bulge to support the hand or the small finger, so that the ring is substantially protected against an unintended contact.

A preferred embodiment of the invention provides that the switch controls a transmitter arranged in the handle of the skipole. The emitter of the transmitter is arranged on the underside of the handle and emits the signals substantially in longitudinal direction of the skipole, whereby the voltage source for the transmitter is preferably also arranged in the handle of the skipole. This permits a very compact design of the device. Also the advantage that the emitting direction of the signals corresponds with the skipole results and same can be aligned easily with the jaw of the binding, which jaw is provided with the suitable release mechanism. The jaw is provided with a suitable receiver, which reacts to the emitted signals and, for example, connects a circuit through to an electromagnet of the release mechanism, which principally can have any desired design. Thus, the electromagnet can operate the release mechanism directly or, for example through hydraulics or pneumatics.

Another modification of the invention provides that the transmitter controlled by the switch is arranged in the area of the basket of the skipole and emits substantially radially with respect to the skipole. The emitter of the transmitter can thereby be aligned, for example, according to a spoke of the basket, which also results in the advantage of an easy control of the emitting direction of the transmitter. Furthermore, this modification offers the advantage of being able to keep the distance between the transmitter and the receiver arranged on the respective jaw very small. Thus very weak transmitters, the energy consumption of which is consequently also very small, are sufficient. This results in a long lifetime of a battery serving as a voltage source.

In order to obtain in a simple manner a reliable reference with respect to the emitting direction of the transmitter secured on the skipole, it is advantageous to provide anatomically formed handles for the skipoles, with the longer cross-sectional axis of which the emitting direction of the transmitter defines a specific angle, or to mount the loop of the handle on same such that the skipole is taken by the hand always in the same manner, which results also in a fixed relationship of the emitting direction of the transmitter with respect to the normal position of the skipole in the hand of the user. A further possibility of a simple marking of the emitting direction of the transmitter is to provide a notch or a color mark indicating the emitting direction of the transmitter on the skipole.

BRIEF DESCRIPTION OF THE DRAWINGS

The invention will now be discussed in greater detail with reference to the drawings in which.

DETAILED DESCRIPTION

Figure 1:
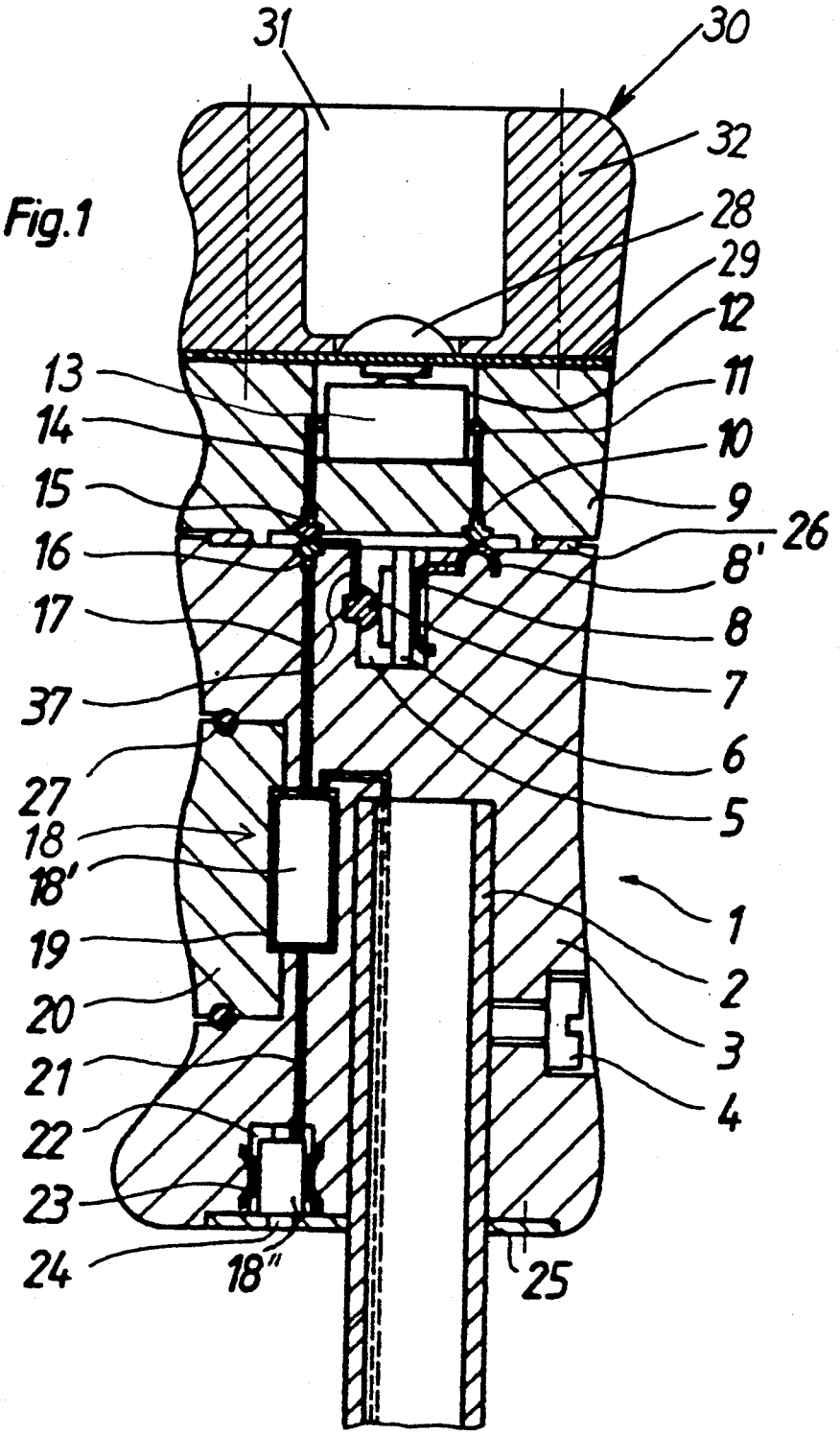
FIG. 1 thereby illustrates a first embodiment of the invention.

The handle 1 of the skipole (sometimes referred to hereinabove and hereinbelow as either "skipole" or "ski pole") 2 is constructed of several parts in the embodiment according to FIG. 1. The gripping part 3 of the handle 1 has thereby a hole in its underside for receiving the free end of the skipole 2. A clamping screw 4 is provided for fixing the connection of the handle to the pole.

A recess 5 is provided in the upper top surface of the gripping part 3 for receiving a battery 6 therein. A contact pin 7 is held on the one wall of the battery and a contact spring 8 is supported on the second wall of the battery. The contact spring is partly embedded in the grip 3, which is manufactured of plastic.

The contact spring 8 has a second resilient section 8' projecting from the upper top surface of the gripping part 3. A contact pin 10 embedded also in the upper part 9 manufactured of insulating plastic rests, when the handle 1 is assembled on the section 8'. A line 11, guided in a bore in the upper part, is conductively connected to the contact pin 10. The line 11 is connected to a switch 13 housed in a recess 12 in the upper top side of the upper part 9. The switch 13 is furthermore connected electrically conductive to a further contact pin 15, embedded in the upper part 9, through a line 14, which is also guided in a bore. The contact pin 15 rests, when the handle 1 is assembled, on a contact pin 16 embedded in the gripping part 3. The contact pin 16 is connected through a line 17 guided in a bore to a transmitter 18' or its oscillator 18'. The oscillator 18' is held in an outwardly open recess 19 of the gripping part 3, which recess 19 is covered by an insert piece 20. The insert piece 20 is connected to the gripping part 3 by means of screws (not illustrated). A series connection of the switch 13 with the oscillator 18', which is fed with current from the battery 6, results.

The oscillator 18' in the embodiment illustrated in FIG. 1 is connected through a line 21 guided in a bore to an emitter 18'' of the transmitter 18, which emitter 18'' is housed in a recess 22 arranged in the underside of the gripping part 3. The position of the emitter 18'' in the recess 22 is maintained by two springs 23 embedded in the walls of the recess 22. The downwardly opening recess 22 is covered by means of a cover plate 25, which has a smaller opening 24 compared with the recess 22 and is connected to the gripping part 3 by means of screws or a snap-lock connection.

The upper part 9 is connected by means of releasable connecting means, for example screws or snap locks (not illustrated), to the gripping part 3. A seal 26 is inserted between the parts. The insert piece 20 is in the same manner provided with a groove receiving an O-ring 27 therein. The gripping part 3 is provided with a shoulder which supports the O-ring 27.

The recess 12 receiving the switch 13 is covered in upward direction by a membrane 29 which has an operating button 28 affixed thereto. The membrane 29 is made of an elastically deformable material, as for example synthetic rubber or the like. The membrane 29 is connected and is clamped to the upper part 9 by means of screws or, however, also other releasable connecting means, and at the same time takes over the function of a seal.

A lid 30 has an annular bulge or rim 32 surrounding a recess 31. The operating button 28 is arranged countersunk in the recess 31 and thus is protected against an unintended operation.

Figure 1A:
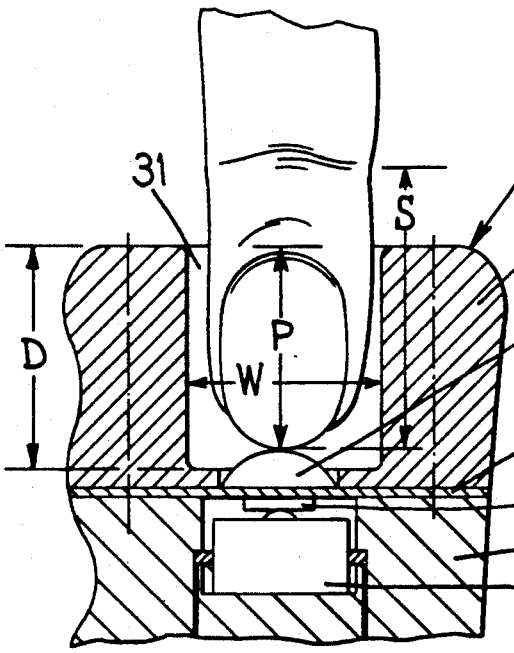
FIGS. 1*a* and 1*b* are enlarged fragmentary sectional views of the upper end portion of the handle.
Figure 1B:
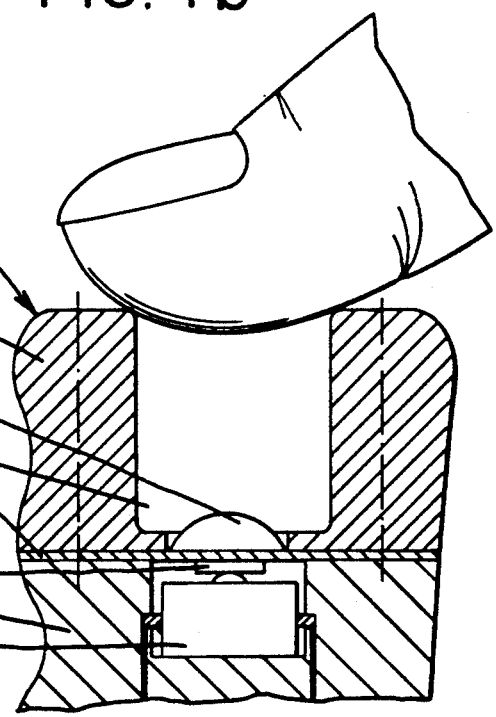

In this particular embodiment, the recess 31 has a depth dimension D greater than a width dimension W. The cross sectional area of the outwardly opening surface opening of the recess 31 is of a sufficient size or width W to limit the reception of one human finger into the surface opening as shown in FIG. 1*a*. The depth dimension P of the top of the button from the top of the handle is in the range of 15 mm to 25 mm, preferably about 20 mm, also preferably equal to or greater than the width dimension W.

Since the operating button 28 lies lower than the upper side of the annular bulge or rim of the lid 30, it is necessary in order to operate the switch 13 that the operating member 33 thereof, which lies just below the underside of the operating button 28, be pressed substantially in longitudinal direction of the skipole 2 by the operating button 28, which due to the bulge 32 is possible only with a longitudinal axis of a finger-end being generally aligned with a longitudinal axis of the ski pole. When this occurs, the distal end segment S of, the finger will be generally aligned with the longitudinal axis of the recess 31. This, however, makes an automatic or unintended operation of the switch 13 impossible. As shown in FIG. 1*a*, the depth of the button 28 in the recess 31 requires a substantial portion P of the distal end segment S of the finger to be inserted into the recess 31 in order to effect an operation of the button 28.

Figure 4:
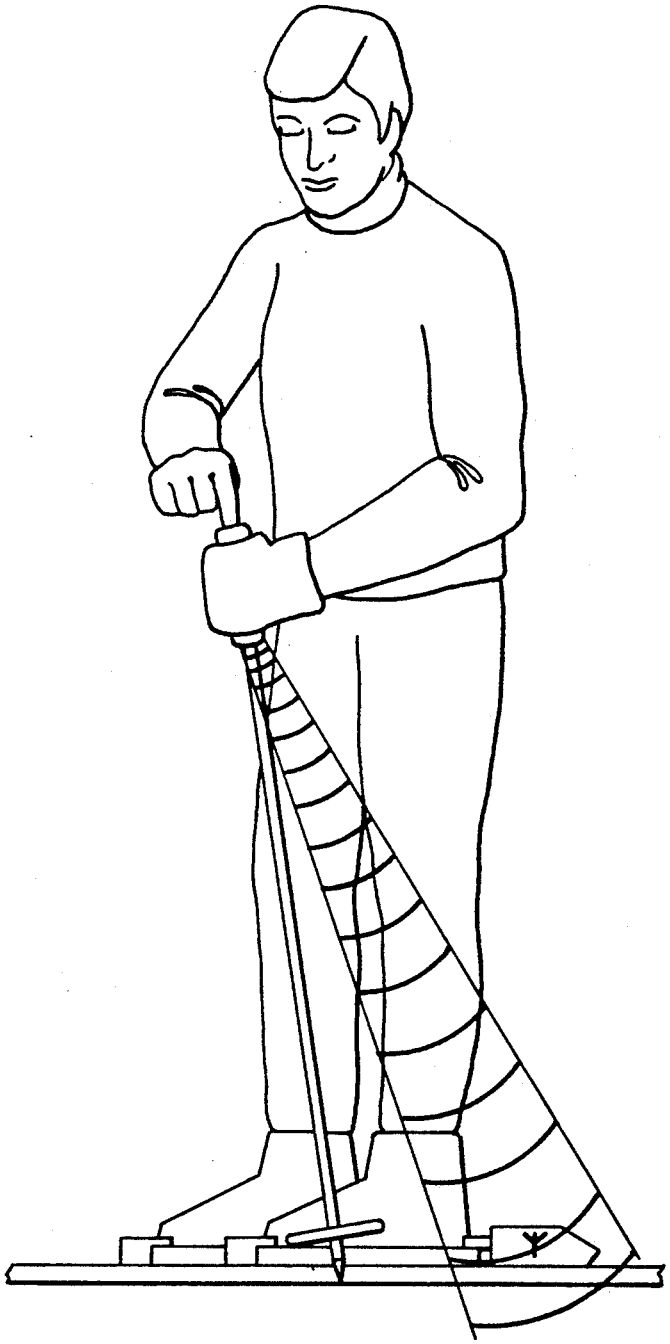
FIG. 4 is a view of a skier on a ski in the process of releasing a ski binding embodying the invention.

An operation of the switch 13 results in activation of the transmitter 18 and thus an emitting of signals which are received by a receiver arranged in a jaw of a ski binding (not illustrated specifically but see FIG. 4) result in an activation of the release mechanism of the binding. Thus, by simply operating the switch 13, the binding can be released voluntarily permitting a comfortable stepping out of the binding without bending down. An undesired release of the binding during downhill skiing, for example due to reactions of fear, is, however, at the same time not possible because of the countersunk arrangement of the operating button 28. Such a release could result in falls surprising and therefore dangerous for the skier.

The emission of the signals of the transmitter 18 is in the embodiment of FIG. 1 done substantially in direction of the longitudinal axis of the skipole 2, so that an easy alignment of the signal emitter to the jaw of the binding, which jaw has the receiver, is possible.

Figure 2:
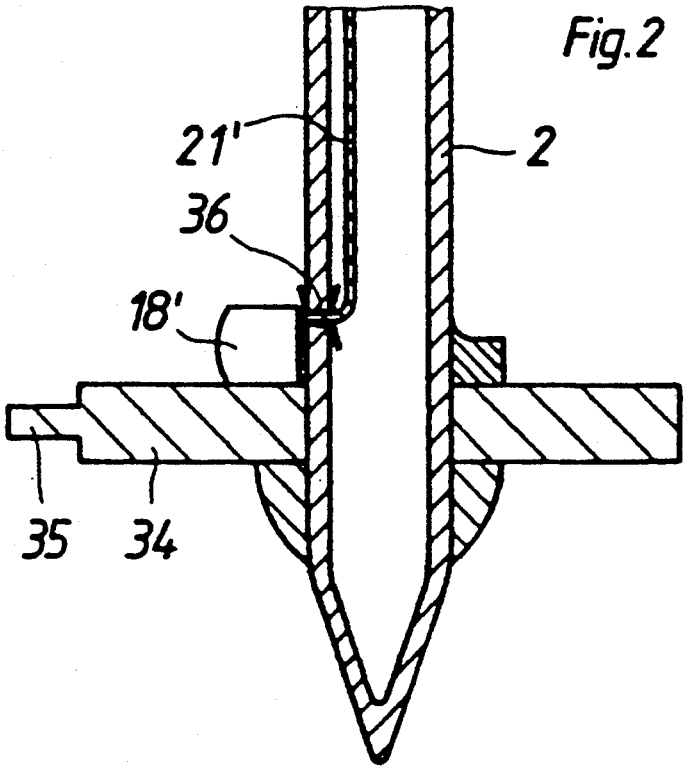
FIG. 2 illustrates a modification of the embodiment according to FIG. 1.

The modified embodiment illustrated in FIG. 2 differs from the one of FIG. 1 in that the emitter 18'' of the transmitter 18 is not arranged in the lower area of the gripping part 3, which area faces the tip of the skipole. Instead the oscillator 18' is secured on the basket 34 of the skipole 2 and being substantially radially aligned. The emitter 18'' can thus be moved without special efforts very close to the jaw of the binding, which jaw has the receiver thereon, so that by aligning the emitter 18'' along a spoke 35 of the basket 34, the emitted signal beam can be easily aligned with the corresponding jaw of the binding, or its receiver. Due to the range of transmission of the transmitter 18, which range needs to be only very close, the transmitter can be operated with extremely little energy, thus resulting in a very long life of the battery. The connection of the oscillator 18' to the emitter 18'' is thereby, as indicated by dashes in FIG. 1, guided in the hollow skipole 2, whereby the line 21' is guided out through a sealing sleeve 36.

To make in this solution the alignment of the transmitter beam with the jaw of the binding, which jaw is provided with the release mechanism, easier, it is preferable to provide an anatomically formed handle 1 for the skipole 2, which assures that the pole is always taken in the hand in the same manner so as to create a fixed relationship between the holding or position of the pole in the hand of the user and the beam direction of the transmitter 18. This, however, can also be accomplished by a suitable mounting of the loop of the handle 1 of the skipole 2, which loop substantially determines the position of the pole in the hand of the user. This also results in a substantially clear fixing of the emitting direction of the transmitter with respect to the position of the pole in the hand of the user, which eases the alignment of the transmitter beam with the corresponding jaw of the binding. A condition is thereby for both cases only that the handle 1 is connected fixed against rotation relative to the basket 34 through the pole.

Figure 3:
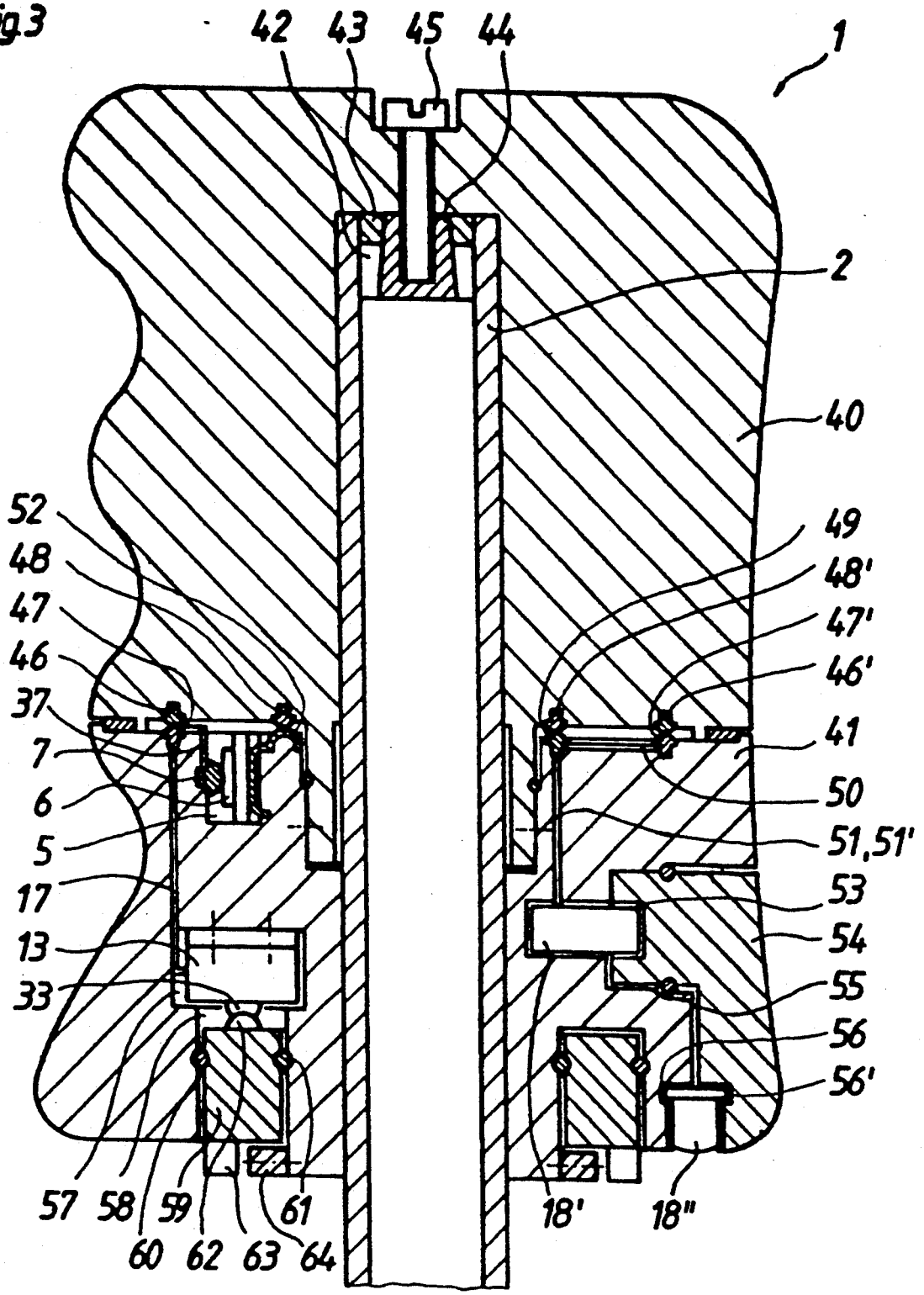
FIG. 3 illustrates a still further embodiment of the invention.

The handle 1 in the embodiment according to FIG. 3 is also constructed of several parts. A gripping part 40, in which the fixing mechanism for securing the connection between the skipole and the handle 2 is arranged, and a lower part 41 are provided. The fixing mechanism is thereby formed by a sleeve 43 moved into the hollow skipole 2 and provided with slots 42 and a cone 44 inserted into the sleeve. The cone 44 is provided with a taphole. By screwing the screw 45 into the taphole of the cone 44, the slotted sleeve 43 is expanded and thus pressed against the inner wall of the skipole 2, thus achieving a fixed connection of the gripping part to the actual skipole 2.

Contact pins 46, 46' or 47, 47' are embedded into the underside of the gripping part 40. The contact pins 46 and 46' are connected through a substantially semicircular conductor path (not illustrated in detail) and the contact pins 47, 47' are connected to another, also not illustrated, similar conductor path. The contact points 46, 46' and 47, 47', which are partly embedded into the material of the gripping part 40, rest, when the handle 1 is assembled, on contact pins 48, 48' and 49 held in the lower part 41 or on a contact spring 52.

The contact spring 52 projects also into a recess 5, which is arranged in the upper side of the lower part 41 and holds a battery 6, and creates a conductive connection with the battery. Furthermore, a contact pin 7 is held in this recess 5' contact pin 7 is connected to the switch 13 through a conductor path 37 and a line 17 connected thereto. The switch 13 is furthermore connected to the contact pin 48, so that a series connection for the switch 13 in relationship to the battery 6 results. The switch 13 is connected in series with the oscillator 18' of the transmitter 18 through the contact pins 48, 46, 46', 48' and a conductor path 50 connected to the latter and a line 51 connected to the conductor path. The oscillator 18' is connected to the battery 6 through the contact spring 52, the contact pin 47, the conductor path connected to the contact pin 47 and the contact pins 47' and 49, and a conductor path connected to the contact pin 49 and a line 51' to the conductor path.

The oscillator 18' is held in an edge-opening recess 53, which can be closed off with an insert edge piece 54, which can be connected to the lower part 41 by means of releasable connecting means (not illustrated). The oscillator 18' is connected to the emitter 18'' by a line 55. The emitter 18'' is held in recesses 56, 56' of the lower part 41 and the insert edge piece 54 in the area of the underside of the lower part 41. The line 55 is thereby laid in a groove, which is arranged in the separating surfaces of the lower part 41 or of the insert edge piece 54.

The switch 13 is housed in a recess 57 arranged on the underside of the lower part 41 and is fixed with screws. The recess 57 is worked into a depression of an annular groove 58 worked into the underside of the lower part 41. A ring 59 extends into the groove 58, or is held rotatably in the groove by means of two O-rings 60, 61. The O-rings serve at the same time as a seal.

The ring 59 has a raised area 62, which cooperates with the operating member 33 of the switch 13 and presses same down upon a suitable rotation of the ring 59, so that the switch 13 closes the circuit and the transmitter 18, consisting of the oscillator 18' and the emitter 18'', is activated, which causes, as already described, a release of the binding.

The ring 59 can be initially tensioned against a rest position not activating the switch 13 by means of a spring (not illustrated). The spring could for example act in peripheral direction and be supported on the ring and the lower part 41.

The ring 59 is further provided with downwardly projecting ribs 63, which make handling of the ring easier. To secure the holding of the ring in the annular groove 58, a retaining ring 64 is provided, which can be releasably connected, for example by means of screws, to the lower part.

To activate the transmitter 18, it is necessary in this modification to rotate the ring 59 relative to the handle 1, for which it should be necessary to grip the skipole with one hand and to rotate the ring 59 with the other hand. This, however, can be carried out by the skier only consciously, not, however, during a fear reaction, so that involuntary releases are for this reason prevented.

Of course, it is also possible in this embodiment of the invention to arrange the emitter 18" of the transmitter, instead of on the underside of the handle 1, in the area of the basket of the skipole. This requires only that the line 55 is either guided downwardly on the outside of the skipole or, as this has been explained in connection with FIG. 3, is guided on the inside of the skipole toward the basket 34.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a ski binding comprising a means for effecting a voluntary release of a lock mechanism on a jaw of a safety ski binding through a wireless transmission path, a switch means for operably controlling signal information in said wireless transmission path, said switch means including a manually operable button arranged on a base means separate from said safety ski binding and used in conjunction with said safety ski binding, the improvement wherein an outwardly opening recess means is provided on said base means, said button being located in said recess means so that a part thereof adapted to be manually engaged is oriented beneath an imaginary extension of the outer surface of said base means so as to protect said button from an unintentional manual engagement, support means on said base means for supporting the entirety of said button for movement in the same direction relative to said base means, said recess means including surrounding wall means of finite dimensions defining a surface opening and a depth dimension to said button that is at least one of equal to and greater than a maximum width dimension for said surface opening, said surface opening having a cross sectional area sufficient to limit the reception of only one human finger into said surface opening, said depth dimension being sufficient to require a longitudinal axis of the finger to be generally aligned with a longitudinal axis of said recess means to enable the finger to be received into said recess means and to manually operate said button to cause said switch means to allow a transmission of signal information in said wireless transmission path to facilitate a release of said lock mechanism on a jaw of said safety ski binding.

2. A ski binding according to claim 1, wherein said switch means includes a signal transmitter means arranged in said base means, an emitter of said signal transmitter means being arranged on an underside of said base means and is adapted to emit signal information in a substantially longitudinal direction of said base means, a voltage source for said signal transmitter means being arranged in said base means of said ski pole.

3. The ski binding according to claim 1, wherein said base means is a handle on a ski pole, and wherein said switch means includes a signal transmitter means arranged in the area of a basket on said ski pole and is adapted to emit signal information substantially radially with respect to said ski pole.

4. The ski binding according to claim 1, wherein said base means is a handle on a ski pole, and wherein said recess means and said button countersunk therein are located on a free top end surface of said handle of said ski pole.

5. The ski binding according to claim 1, wherein said support means includes an elastically deformable membrane forming a bottom wall of said recess means, said button being mounted on said membrane and movable therewith.

6. The ski binding according to claim 5, wherein said membrane serves to limit movement of said button to a direction parallel to said longitudinal axis of said recess means.

* * * * *